US006749259B2

(12) United States Patent
Ware et al.

(10) Patent No.: US 6,749,259 B2
(45) Date of Patent: Jun. 15, 2004

(54) GANGING DEVICE FOR STACKBAR OF STACKABLE CHAIR

(75) Inventors: R. Duane Ware, Temperance, MI (US); William F. Lohness, Jonesville, MI (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 0 days.

(21) Appl. No.: 10/208,293

(22) Filed: Jul. 30, 2002

(65) Prior Publication Data

US 2003/0201661 A1 Oct. 30, 2003

Related U.S. Application Data

(60) Provisional application No. 60/375,211, filed on Apr. 24, 2002.

(51) Int. Cl.[7] ..... A47C 15/00

(52) U.S. Cl. ..... 297/248; 297/232

(58) Field of Search ..... 297/248, 249, 297/243, 244, 245, 440.1; 248/222.41, 225.11

(56) References Cited

U.S. PATENT DOCUMENTS

| | | | | | |
|---|---|---|---|---|---|
| 2,956,618 | A | | 10/1960 | Eames et al. | 155/130 |
| 3,018,131 | A | | 1/1962 | Krueger | 297/248 |
| 3,084,977 | A | | 4/1963 | Chapman | 297/239 |
| 3,123,399 | A | * | 3/1964 | Wilson | 297/239 |
| 3,127,218 | A | | 3/1964 | Banke | 297/248 |
| 3,133,762 | A | | 5/1964 | Newman | 297/239 |
| 3,159,425 | A | | 12/1964 | Engstrom | 297/248 |
| 3,174,795 | A | | 3/1965 | Chapman et al. | 297/160 |
| 3,203,731 | A | | 8/1965 | Krueger | 297/239 |
| 3,227,487 | A | | 1/1966 | Blanchard, Jr. et al. | 297/248 |
| 3,291,523 | A | | 12/1966 | Krueger | 297/239 |
| 3,314,718 | A | * | 4/1967 | Crandall | 297/239 |
| 3,328,075 | A | | 6/1967 | Albinson | 297/239 |
| 3,497,262 | A | | 2/1970 | Piretti et al. | 297/239 |
| 3,610,686 | A | | 10/1971 | Caruso | 297/239 |
| 3,614,157 | A | | 10/1971 | Hendrickson | |
| 3,620,567 | A | | 11/1971 | Hendrickson | 297/248 |
| 3,669,491 | A | * | 6/1972 | Weslock | 297/248 |
| 3,695,694 | A | | 10/1972 | Mohr | 297/248 |
| 3,697,130 | A | | 10/1972 | Barecki et al. | 297/248 |
| 3,758,155 | A | * | 9/1973 | Straits | 297/248 |
| 3,827,749 | A | | 8/1974 | Johnson et al. | 297/248 |
| 3,847,433 | A | | 11/1974 | Acton et al. | 297/239 |
| 4,154,476 | A | | 5/1979 | Blodee | 297/248 |
| 4,386,804 | A | | 6/1983 | Ware et al. | 297/248 |

(List continued on next page.)

FOREIGN PATENT DOCUMENTS

| | | | | |
|---|---|---|---|---|
| DE | 3610225 A1 | * | 10/1987 | A47C/1/124 |
| EP | 0 195 647 A2 | | 9/1986 | A47C/1/124 |
| GB | 2 094 139 A | | 9/1982 | A47C/1/124 |
| GB | 2 103 476 A | | 2/1983 | A47C/1/124 |
| GB | 2 188 232 A | | 9/1987 | A47C/1/124 |

*Primary Examiner*—Peter M. Cuomo
*Assistant Examiner*—Stephanie Harris
(74) *Attorney, Agent, or Firm*—Gifford, Krass, Groh, Sprinkle, Anderson & Citkowski, PC

(57) ABSTRACT

A chair includes a generally horizontal seating surface with four legs extending downwardly from the seating surface. A first stiffener bar extends between and interconnects the front left leg and the rear left leg. A second stiffener bar extends between and interconnects the front right leg and the rear right leg. A ganger feature is provided for interconnecting the chair with a like chair in a side-by-side arrangement. The ganger feature is a ganger bracket interconnected with one of the stiffener bars and extending outwardly to an outward edge. An engagement tab extends upwardly from the outward edge. The other stiffener bar has a lower surface with a slot defined therein. The slot is sized and positioned so as to receive the engagement tab of a like chair so as to interconnect the chairs.

20 Claims, 3 Drawing Sheets

U.S. PATENT DOCUMENTS

| | | | | | |
|---|---|---|---|---|---|
| 4,400,031 | A | * | 8/1983 | DeDecker | 297/239 |
| 4,655,504 | A | | 4/1987 | Weber | 297/239 |
| 5,002,337 | A | | 3/1991 | Engel et al. | 297/239 |
| 5,282,669 | A | * | 2/1994 | Barile | 297/248 |
| D363,658 | S | * | 10/1995 | Barile | D8/382 |
| 5,863,096 | A | * | 1/1999 | Bartlmae | 297/248 |
| 5,957,530 | A | | 9/1999 | Gutgsell | |
| 6,106,061 | A | | 8/2000 | Caruso et al. | 297/239 |
| 6,206,469 | B1 | * | 3/2001 | Caruso et al. | 297/248 |
| D443,995 | S | * | 6/2001 | Caruso et al. | D6/374 |
| 6,338,528 | B1 | * | 1/2002 | Lohness et al. | 297/248 |
| 6,406,094 | B2 | * | 6/2002 | Lohness et al. | 297/248 |
| D483,577 | S | * | 12/2003 | Rietz | D6/336 |

* cited by examiner

GANGING DEVICE FOR STACKBAR OF STACKABLE CHAIR

REFERENCE TO RELATED APPLICATION

This application claims priority from U.S. provisional application Serial No. 60/375,211 filed Apr. 24, 2002, the entire contents of which are incorporated herein by reference.

FIELD OF THE INVENTION

The present invention relates generally to a ganger device for chairs and, more specifically, to a ganger device that interconnects stiffener bars that extend between front and rear legs of adjacent chairs.

BACKGROUND OF THE INVENTION

Convention halls, auditoriums, and banquet halls often use individual stackable chairs to provide additional seating during particular events. When not in use, these chairs may be stacked and stored. When the chairs are unstacked and arranged for use, it is sometimes desirable to arrange and interlock the chairs into straight rows. This may also be referred to as "ganging" the chairs. For this purpose, some chairs include ganger brackets for interlocking each chair with its immediately adjacent neighboring chair or chairs. Ganger brackets typically take the form of some type of hook extending from one side of the chair and a corresponding engagement loop or surface on the opposite side of the chair. Then, two identical chairs may be interlocked by the hook portion of one chair interlocking with the loop or surface of its neighboring chair.

A typical stacking chair has a generally horizontal rectangular seating surface with a leg extending downwardly from each of the four corner of the seating surface. One common type of ganger bracket assembly includes a ganger hook bracket that extends between the front and back legs on one side of the chair. The bracket is a flat member with a downwardly turned upper edge. The downwardly turned upper edge gives the hook bracket a generally hooked-shaped cross section. Specifically, the hook bracket has a cross section that generally resembles an upside down letter J. The upper hook portion of the bracket extends outwardly from the flat surface and from the chair. The engagement bracket that forms the other part of the ganger bracket assembly is simply a flat member which extends from the front leg to the rear leg on the side of the chair opposite the hook bracket. Both the hook bracket and engagement bracket are positioned a few inches below the seating surface and generally horizontal.

In use, two chairs with the same ganger bracket assemblies are positioned side-by-side with the hook bracket of one immediately adjacent the engagement bracket of the other. One chair is then lifted slightly so that the hook portion attached thereto can pass over the top of the engagement bracket on the other chair. When the chair is set back down, the two brackets are inter-hooked so that the chairs are maintained immediately adjacent and parallel to one another.

The above described type of ganger assembly has several shortcomings. First, the hook assembly and the engagement bracket do not have an aesthetically pleasing appearance. This may be acceptable for certain applications, but is undesirable. Another shortcoming is that this type of ganger assembly positions and interlocks adjacent chairs very close to one another. In some applications, it is desirable to provide slightly more spacing between adjacent chairs, while still being able to interlock the chairs.

In light of the above, there remains a need for chairs with improved ganger brackets.

SUMMARY OF THE INVENTION

A chair according to the present invention overcomes many of the shortcomings of the prior art. The chair includes a generally horizontal seating surface with four legs extending downwardly from the seating surface. The legs include a front left leg, a front right leg, a rear left leg, and a rear right leg. Each of the legs have an upper end adjacent to the seating surface, a lower end configured to contact a support surface, and a midportion between the upper and lower ends. A first stiffener bar extends between and interconnects the front left leg and the rear left leg. The first stiffener bar has a first end interconnected with the midportion of the front left leg and a second interconnected with the midportion of the rear left leg. A second stiffener bar extends between and interconnects the front right leg and the rear right leg. The second stiffener bar has a first end interconnected with the midportion of the front right leg and a second end interconnected with the midportion of the rear right leg. A ganger feature is provided for interconnecting the chair with a like chair in a side-by-side arrangement. The ganger feature is a ganger bracket interconnected with one of the stiffener bars. The ganger bracket extends outwardly from the stiffener bar to an outward edge and has an engagement tab that extends upwardly from the outward edge. The other stiffener bar has a lower surface with a slot defined in it. The slot is sized and positioned to receive the engagement tab of a like chair so as to interconnect the chairs.

DETAILED DESCRIPTION OF THE PREFERRED EMBODIMENTS

Figures 1, 2, 3:
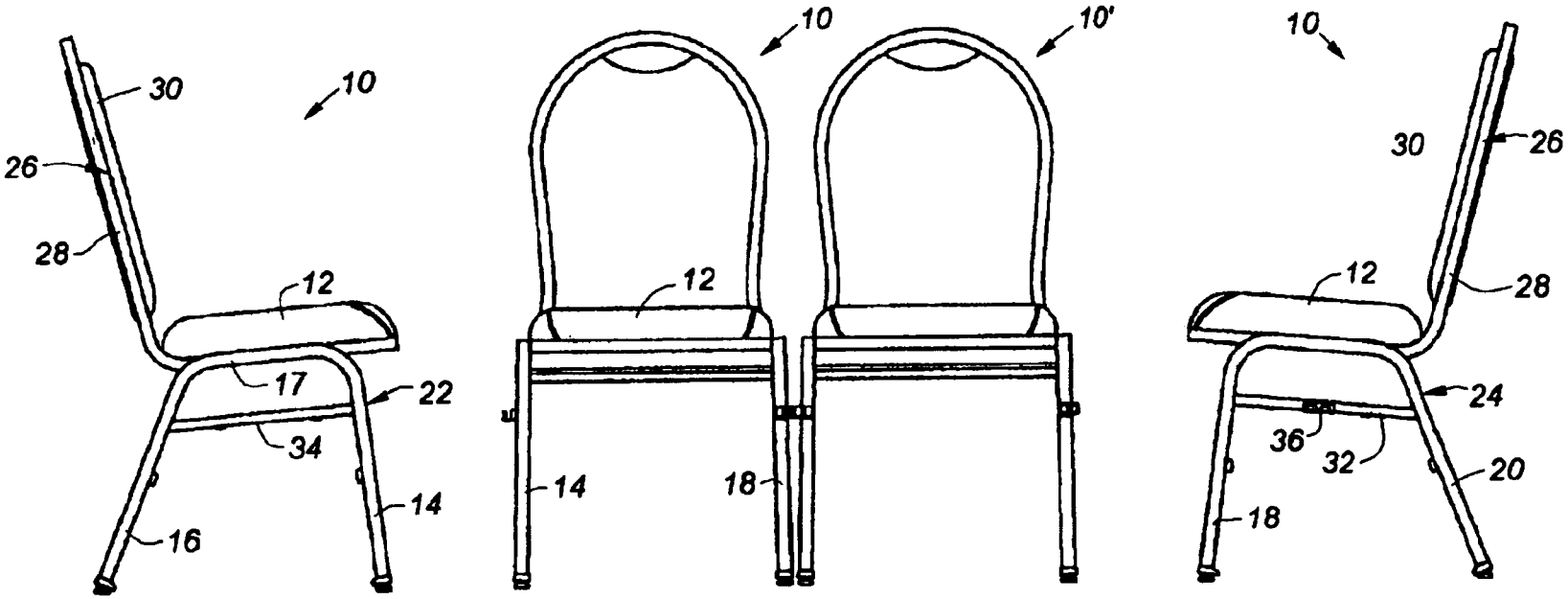
FIG. 1 is a side elevational view of a stackable chair according to the present invention.
FIG. 2 is a front elevation view of a pair of chairs according to the present invention, interlocked in the side-by-side position using a ganging feature, which forms part of the present invention.
FIG. 3 is a side elevational view of the chair of FIG. 1, showing the side opposite the side illustrated in FIG. 1.

Referring to FIGS. 1–3, a chair 10 according to the present invention is shown at different angles. FIG. 2 shows a second identical chair 10' interconnected with the chair 10 by a ganger feature according to the present invention. As is typical, the chair 10 includes a generally horizontal seating surface 12 with four legs supporting the seating surface 12 and extending downwardly to contact the floor. The legs may be said to include a front right leg 14, a rear right leg 16, a front left leg 18, and a rear left leg 20. Further, each of the legs 14–20 may be said to have an upper end adjacent the seating surface 12 and a lower end configured to contact a floor or other support surface. Each of the legs may be said to have a midportion between their upper and lower ends. While the chair according to the present invention may take a variety of forms, preferably it is a stacking chair of the design illustrated in FIGS. 1–3. In this design, the legs are formed by inverted U-shaped members, with each member defining a front leg portion, a rear leg portion and generally horizontal portion interconnecting the front and rear portions. For example, the front right leg 14 and rear right leg 16 are together part of an inverted U-shaped member 22, with the front right leg 14 being the front leg portion, the rear right leg 16 being the rear leg portion, and the horizontal portion being indicated at 17. Likewise, a second inverted U-shaped member 24 includes the front left leg 18 and rear left leg 20. A back 26 extends upwardly from the rear of the chair to support the back of an occupant sitting on the seating surface 12. The back 26 may be provided in a variety of ways. In the illustrated embodiment, the back 26 includes a generally L-shaped perimeter frame 28 that surrounds a cushion 30. The lower legs of the perimeter frame 28 attach to the upper horizontal portions of the inverted U-shaped members 22 and 24.

A first bar 32 extends between and interconnects the fronc left leg 18 and the rear left leg 20. Likewise, a second bar 34 extends between and interconnects the front right leg 14 and rear right leg 16. The bars 32 and 34 preferably are generally parallel to the seating surface 12 and spaced downwardly therefrom. This means that the bars 32 and 34 are generally horizontal, and also are generally parallel to and spaced down from the horizontal portions of the U-shaped members. As will be clear to those of skill in the art, when the chairs 10 are stacked one on top of another, the bar of an upper chair in the stack rests on the upper horizontal portion of the inverted U-shaped members of the chair that is lower in the stack. The bars provide for a secure stack of chairs and prevent the legs on the upper chair becoming wedged onto the legs of the lower chair. Preferably, the bars are formed out of rectangular square tubing. In addition to serving as a stack limited the bars 32 and 34 also serve to stiffen the front and rear legs on each side of the chair. Therefore, the bars 32 and 34 may be alternatively referred to as stiffener bars or stack bars. Together, the U-shaped members 22 and 24, the frame 28, and the bars 32 and 34 form a portion of the chair 10 chat may be referred to as a base 11.

In the present invention, the stack bars 32 and 34 include a ganger feature that allows adjacent chairs to be interlocked in a side-by-side position, such as shown in FIG. 2. For this purpose, the ganger feature comprises a ganger 36 extending outwardly from one of the stack bars (in this case, bar 32) and a corresponding slot (not shown in FIGS. 1–3) defined in the underside of the other stack bar (in this case, bar 34). Alternatively, the ganger bracket and slot may be traded between the two stack bars. In either case, the provision of the ganger bracket and the corresponding slot allow adjacent chairs with the same ganger arrangement to interlock, by the ganger bracket of one chair engaging the slot in the adjacent chair. Preferably, this maintains the chairs in an aligned side-by-side position, such that they form an aesthetically pleasing row.

Figure 4:
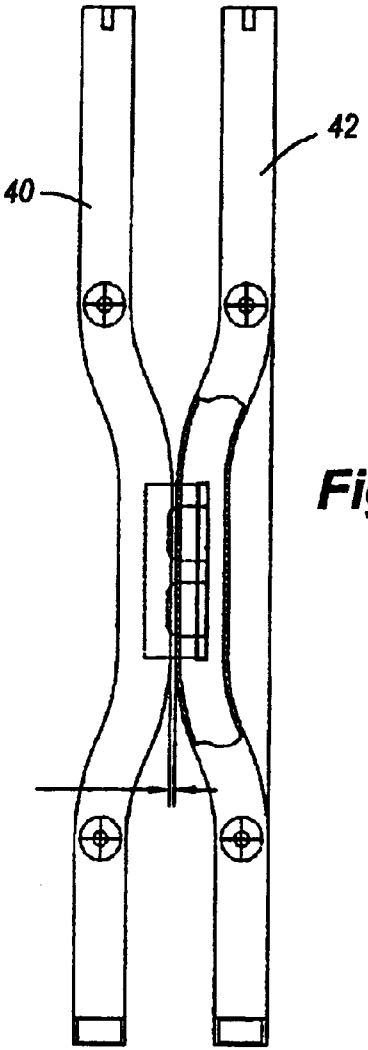
FIG. 4 is a top plan view of the stack bars for two adjacent chairs, with one stack bar partially cut away.

Referring now to FIG. 4, a preferred configuration for stack bars according to the present invention is shown. A first stack bar is generally shown at 40 and a second stack bar is shown generally at 42. The stack bars 40 and 42 are shown in an interlocked position without the chairs being shown. However, one of the stack bars would be attached to the legs on one side of the chair and the other stack bar would be attached to the legs on the other side of the chair. As shown, the stack bars 40 and 42 preferably are not straight. Instead, a midsection of each one is bent outwardly with respect to the chair to which it would be attached so as to bring the midsections of the stack bars 40 and 42 into closer proximity. This reduces the length of the ganger feature on one of the stack bars. As will be clear to those of skill in the art, the outer edges of the stack bars 40 and 42 may be brought into closer proximity in other ways. For example, one of the stack bars may be bent outwardly while the other remains straight. As a further alternative, the stack bars may be widened or thickened along part or all of their length so as to bring their outer surfaces into closer proximity. As yet another alternative, the ganger bracket may be made longer, with the bars being less proximal. The outward bend in each of the stack bars 40 and 42 also allows adjacent chairs to be interlocked with a slight spacing therebetween. In addition, it allows use of the ganger devices with chairs wherein the legs slope slightly toward the side, as shown in FIG. 2.

Figure 5:
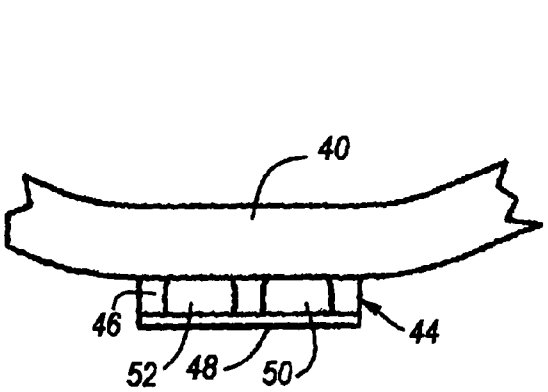
FIG. 5 is a top elevational view of a portion of a stack bar showing a ganger bracket extending from the stack bar.
Figure 6:
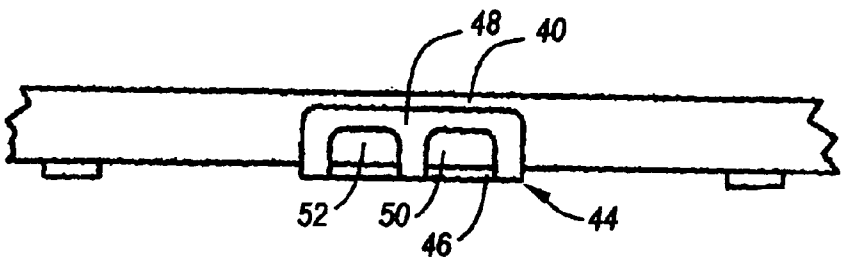
FIG. 6 is a side elevational view of a portion of a stack bar and ganger bracket.

FIG. 5 shows a top view of the midsection of the first stack bar 40, and FIG. 6 shows a side view. The ganger bracket 44 is preferably connected to the underside of the stack bar 40 and extends outwardly therefrom. It has a generally horizontal portion 46 that is attached to the lower surface of the stack bar 40 and extends outwardly, and a generally vertical portion 48 that extends upwardly from the horizontal portion 46. The vertical portion 48 is an elongated blade or tab, preferably formed out of metal. As shown, the ganger bracket may have openings 50 and 52 therein.

Figure 7:
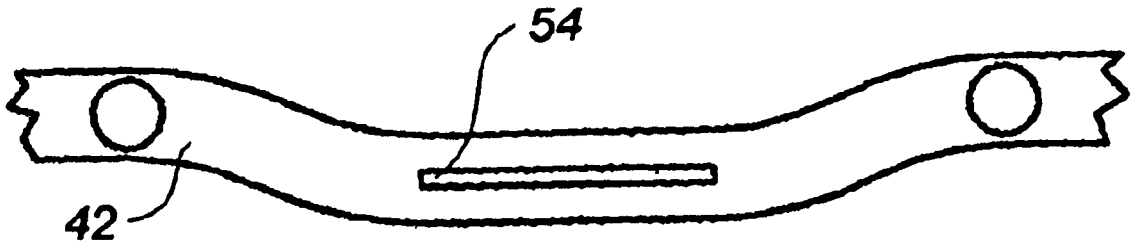
FIG. 7 is a bottom plan view of a stack bar with a ganger bracket receiving slot.

FIG. 7 shows a view of the lower surface of the midsection of the second stack bar 42. As shown, the stack bar 42 has a slot 54 defined in the underside. The slot 54 is sized and positioned to receive the generally vertically portion 48 of the engagement tab 48 of the ganger bracket 44. Preferably, the fit of the tab into the slot has reasonably close tolerances so that there is little play between the adjacent chairs. As will be clear to those of skill in the art, the tab and slot may be various sizes, positions, and shapes as long as they are sized and positioned so as to cooperate to interlock adjacent chairs in an aligned, side-by-side relationship. In one embodiment, the engagement tab 48 of the ganger bracket 44 has a front-to-back length of approximately two inches and a thickness or width of approximately 3/32 inch. The corresponding slot has a front-to-back length of approximately two and 1/16 inches and a width of approximately 1/8 inch. As shown, the ganger bracket 44 and the slot 54 are both positioned at approximately the same front-to-back location on the two stack bars. That is, each is positioned at approximately the same distance from the front of its respective stack bar. This positioning causes chairs that are interlocked using the ganger feature to be positioned in a neat row.

Figure 8:
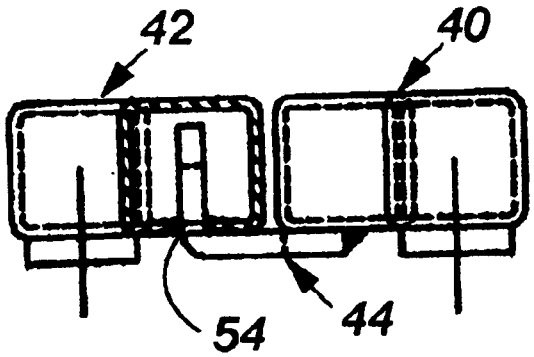
FIG. 8 is a cross-sectional view of side-by-side stack bars with the ganger bracket of one stack bar engaging a receiving slot in the other bar.

FIG. 8 shows cross-sectional views of adjacent stack bars with the ganger bracket 44 shown extending from stack bar 40 and being received in slot 54. As shown, the stack bar 42 may be said to have an upper surface 60, an opposed lower surface 62, and a pair of side surfaces 64 and 66 extending between and interconnecting the upper surface 60 and lower surface 62. The lower surface 62 faces the floor when the chair is setting on the floor, and the side surfaces 64 and 66 face inwardly and outwardly, respectively. The upper surface 60 and lower surface 62 may be said to be generally horizontal while the side surfaces 64 and 66 may be to said to be generally vertical. As shown the slot 54 is defined in the lower surface 62 midway between the side surfaces 64 and 66. Also, as shown, the side surfaces 64 and 66 are uninterrupted. That is, the ganger feature does not require an opening in the side surfaces 64 and 66.

As will be clear to those of skill in the art, the embodiment of the present invention disclosed herein may be altered in various ways without departing from the scope or teaching of the present invention. It is the following claims, including all equivalents, which define the scope of the present invention.

We claim:

1. A chair comprising:

a generally horizontal seating surface;

four legs extending downwardly from said generally horizontal seating surface, said legs comprising a front left leg, a front right leg, a rear left leg, and a rear right leg, each of said legs having an upper end adjacent said seating surface, a lower end configured to contact a support surface, and a midportion therebetween;

a first stiffener bar extending between and interconnecting said front left leg and said rear left leg, said first stiffener bar having a first end interconnected with said midportion of said front left leg and a second end interconnected with said midportion of said rear left leg;

a second stiffener bar extending between and interconnecting said front right leg and said rear right leg, said second stiffener bar having a first end interconnected with said midportion of said front right leg and a second end interconnected with said midportion of said rear right leg;

each of said stiffener bars having an upper surface, an opposed lower surface, and a pair of side surfaces;

a ganger feature for interconnecting said chair with a like chair in a side-by-side arrangement, said ganger feature comprising a ganger bracket interconnected with one of said stiffener bars and extending outwardly therefrom to an outward edge, said ganger bracket further having an engagement tab extending upwardly from said outward edge; and the other of said stiffener bars having a slot defined in the lower surface and positioned to be spaced from the side surfaces, said slot being sized and positioned so as to receive the engagement tab of a like chair so as to interconnect said chair with the like chair.

2. The chair according to claim 1, wherein said first and second stiffener bars each have a midsection defined between said first and second ends, each of said stiffener bars being curved such that said midsection extends outwardly with respect to said first and second ends, said ganger bracket being interconnected with said midsection of said one of said stiffener bars and said slot in said other of said stiffener bars being defined in said lower surface of said midsection of said other of said stiffener bars.

3. The chair according to claim 1, wherein said stiffener bars each comprise tubular members.

4. The chair according to claim 3, wherein said tubular members have rectangular cross sections.

5. The chair according to claim 1, wherein said stiffener bars are generally horizontal.

6. The chair according to claim 1, wherein said ganger bracket has a forward edge that is spaced from said first end of said one of said stiffener bars by a predetermined distance, said slot in said other of said stiffener bars having a forward edge that is spaced from said first end of said other of said stiffener bars by approximately the same predetermined distance.

7. The chair according to claim 1, wherein said one of said stiffener bars has a lower surface, said ganger bracket being interconnected with said lower surface of said one of said stiffener bars.

8. The chair according to claim 7, wherein said ganger bracket comprises a metal flange with an inward end connected to said lower surface, said ganger bracket extending generally horizontally outwardly and bending upwardly so as to define said engagement tab.

9. The chair according to claim 1, further comprising a seat back extending upwardly from an edge of said seating surface.

10. A stackable chair comprising:

a base having a pair of generally parallel inverted U-shaped leg members spaced apart so as to define opposite sides of the base, each leg member including a front leg portion, a rear leg portion, and a generally horizontal portion interconnecting the front and rear leg portions, the base further having a generally horizontal seat cushion frame extending between and interconnecting the U-shaped leg members;

a first stiffener bar extending between and interconnecting said front leg portion and said rear leg portion of one of said leg members, said first stiffener bar being spaced below said generally horizontal portion of said one of said leg members;

a second stiffener bar extending between and interconnecting said front leg portion and said rear leg portion of the other of said leg members, said second stiffener bar being spaced below said generally horizontal portion of said other of said leg members;

each of said stiffener bars comprising a tubular member having an upper surface, an opposed lower surface, and a pair of side surfaces;

a ganger feature for interconnecting said chair with a like chair in a side-by-side arrangement, said ganger feature comprising a ganger bracket interconnected with said first stiffener bar and extending outwardly therefrom, said ganger bracket further comprising an upwardly extending engagement tab spaced from said first stiffener bar; and said second stiffener bar having a slot defined in said lower surface of said tubular member, said slot being defined intermediate said side surfaces such that said side surfaces are uninterrupted, said slot being configured to receive the engagement tab of a like chair so as to interconnect said chair with the like chair.

11. The chair according to claim 10, wherein said first and second stiffener bars each have a midsection, each of said stiffener bars being curved such that said midsection extends outwardly with respect to said leg member, said ganger bracket being interconnected with said midsection of said first stiffener bar and said slot in said second stiffener bar being defined in said lower surface of said midsection of said second stiffener bar.

12. The chair according to claim 10, wherein said tubular members have rectangular cross sections.

13. The chair according to claim 10, wherein said stiffener bars are generally horizontal.

14. The chair according to claim 10, wherein said ganger bracket has a forward edge that is spaced from said front leg portion of said one of said leg members by a predetermined distance, said slot in said second stiffener bar having a forward edge that is spaced from said front leg portion of said other of said leg members by approximately the same predetermined distance.

15. The chair according to claim 10, wherein said ganger bracket is interconnected with said lower surface of said first stiffener bar.

16. The chair according to claim 15, wherein said ganger bracket comprises a metal flange with an inward end connected to said lower surface, said ganger bracket extending generally horizontally outwardly and bending upwardly so as to define said engagement tab.

17. The chair according to claim 10, further comprising a seat back interconnected with said base and extending upwardly from an edge of said seating surface.

18. A stackable chair comprising:

a base having a pair of generally parallel inverted U-shaped leg members spaced apart so as to define opposite sides of the base, each leg member including a front leg portion, a rear leg portion, and a generally horizontal portion interconnecting the front and rear leg portions, the base further having a generally horizontal seat cushion frame extending between and interconnecting the U-shaped leg members;

a seat back frame interconnected with said base and extending upwardly therefrom;

a first stiffener bar extending between and interconnecting said front leg portion and said rear leg portion of one of said leg members, said first stiffener bar being generally parallel to and spaced below said generally horizontal portion of said one of said leg members, said first stiffener bar comprising an elongated tubular member having a first end interconnected with said front leg portion, a second end interconnected with said rear leg portion, and a midsection therebetween, said tubular member being curved such that said midsection extends outwardly with respect to said first and second ends;

a second stiffener bar extending between and interconnecting said front leg portion and said rear leg portion of the other of said leg members, said second stiffener bar being generally parallel to and spaced below said generally horizontal portion of said other of said leg members, said second stiffener bar comprising an elongated tubular member having a first end interconnected with said front leg portion, a second end interconnected with said rear leg portion, and a midsection therebetween, said tubular member being curved such that said midsection extends outwardly with respect to said first and second ends;

each of said stiffener bars having a generally horizontal lower surface extending between a pair of side surfaces;

a ganger feature for interconnecting said chair with a like chair in a side-by-side arrangement, said ganger feature comprising a ganger bracket interconnected with said lower surface of said midsection of one of said stiffener bars, said ganger bracket extending generally horizontally outwardly from said midsection and bending upwardly so as to define an upwardly extending engagement tab spaced from said one of said stiffener bars, said ganger bracket having a forward edge that is spaced from said first end of said one of said stiffener bars by a predetermined distance; and the other of said stiffener bars having a slot defined in said lower surface of said midsection of said tubular member intermediate the side surfaces, said slot being configured to receive the engagement tab of a like chair so as to interconnect said chair with the like chair, said slot having a forward edge that is spaced from said first end of said other of said stiffener bars by approximately the same predetermined distance.

19. A chair comprising:

a generally horizontal seating surface;

four legs extending downwardly from the generally horizontal seating surface, the legs comprising a front left leg, a rear left leg, a front right leg, and a rear right leg;

a first stack bar extending between and interconnecting the front left leg and the rear left leg;

a second stack bar extending between and interconnecting the front right leg and the rear right leg;

each of said stack bars having an upper surface, an opposed lower surface, and a pair of side surfaces; and a ganger feature comprising;

a ganger tab connected to one of the stack bars and extending outwardly therefrom, the ganger tab having a generally horizontal portion attached to the stack bar and extending outwardly therefrom and a generally vertical portion extending upwardly from the generally horizontal portion, the generally vertical portion comprising a flat member having a front to back length substantially shorter than the front to back length of the stack bars; and a slot defined in the lower surface of the other of the stack bars intermediate the side surfaces, the slot positioned and sized to receive the generally vertical portion of a ganger tab on a substantially identical adjacent chair such that the ganger tab on the adjacent chair and the slot receiving the tab cooperate to retain the chairs in an aligned side-by-side arrangement.

20. The chair according to claim 19, wherein each of the stack bars have a mid portion that extends outwardly.

* * * * *

UNITED STATES PATENT AND TRADEMARK OFFICE

CERTIFICATE OF CORRECTION

PATENT NO. : 6,749,259 B2 
DATED : June 15, 2004
INVENTOR(S) : R. Duane are; William F. Lohness It is certified that error appears in the above-identified patent and that said Letters Patent is hereby corrected as shown below:

Column 1,
Line 35, replace “corner” with -- corners --.

Column 3,
Line 3, replace “chair becoming” with -- chair from becoming --.
Line 26, replace “fronc” with -- front --.
Line 42, replace “limited the” with -- limiter, the --.
Line 47, replace “chart” with -- that --.

Signed and Sealed this

Twenty-fourth Day of May, 2005

JON W. DUDAS
*Director of the United States Patent and Trademark Office*